US007523633B1

(12) United States Patent
Mielke

(10) Patent No.: US 7,523,633 B1
(45) Date of Patent: Apr. 28, 2009

(54) WIRE TRAY JIG AND BENDING METHOD

(76) Inventor: Laurence H. Mielke, 8112-92 Ave., Fort Saskatchewan, Alberta (CA) T8L 3N5

( * ) Notice: Subject to any disclaimer, the term of this patent is extended or adjusted under 35 U.S.C. 154(b) by 0 days.

(21) Appl. No.: 11/258,798

(22) Filed: Oct. 27, 2005

(51) Int. Cl.
*B21D 11/00* (2006.01)

(52) U.S. Cl. ..... 72/301; 72/305

(58) Field of Classification Search ..... 72/301, 72/295, 298, 305, 310, 308, 316, 384–386, 72/388, 31.11, 419, 420, 428; 140/92.1, 140/123

See application file for complete search history.

(56) References Cited

U.S. PATENT DOCUMENTS

| | | | | | |
|---|---|---|---|---|---|
| 382,426 | A * | 5/1888 | Howe | 72/301 |
| 996,064 | A * | 6/1911 | Costello | 72/298 |
| 1,001,244 | A * | 8/1911 | Brown | 72/301 |
| 1,124,251 | A * | 1/1915 | Anderson | 72/385 |
| 1,512,002 | A * | 10/1924 | Kardong | 72/2 |
| 2,086,736 | A * | 7/1937 | Palmer | 72/385 |
| 3,430,478 | A * | 3/1969 | Arnold | 72/298 |
| 4,100,787 | A * | 7/1978 | Straza et al. | 72/310 |
| 5,345,799 | A * | 9/1994 | Miodushevski et al. | 72/19.8 |
| 5,934,132 | A * | 8/1999 | Nichol | 72/301 |

* cited by examiner

*Primary Examiner*—Dana Ross
*Assistant Examiner*—Debra M Sullivan
(74) *Attorney, Agent, or Firm*—G. F. Gallinger

(57) ABSTRACT

A jig for bending a wire tray comprising: a base to carry a rear end portion of the wire tray, having a front end portion having two spaced points adapted for hangable connection; b) two swinging arms each hingably attached to the front end portion of the base; c) an arm spacer having a rear end portion having two spaced points, adapted for hangable connection, and attached to a central point on a corresponding swinging arm, so that movement of either arm moves the other arm in parallel alignment thereto; d) an interior block/clamp positioned within and thereafter clamped to the wire tray on the base; e) an interior block/clamp positioned within and thereafter clamp the wire tray on the spacer; and wherein, f) an interior side portion of the base surrounds the wire tray. When the block/clamps are properly secured within the rear and front end portions of the wire tray then the wire tray is prevented from bending.

17 Claims, 2 Drawing Sheets

WIRE TRAY JIG AND BENDING METHOD

FIELD OF THE INVENTION

This invention relates to installation of industrial electrical wiring. More particularly this invention relates to a method of bending wire trays which are used to support and route electrical wires. Electrical wires or cables extend between control and power locations to electrical equipment throughout a commercial building or industrial plant.

BACKGROUND OF THE INVENTION

Large industrial projects employ miles and miles of wire trays. These wire trays usually are required to bend over or around piping, vessels, and equipment as wires and cables are routed from control and power locations to the equipment which is controlled. The wires and cables are carried in wire trays. Twenty years ago U shaped plastic wire trays were commonly used. More recently wire trays which are made of straight steel rods having spaced U shaped rods welded therealong began to be used. These steel wire trays are preferred because they can be cut and reattached at varying angles so that the otherwise straight wire trays can be bent over or around piping, vessels, and equipment as they are routed. Probably the biggest problem with cutting and reattaching these steel wire trays is that it is extremely time consuming. The wire trays must be held while they are sawn off at measured angles. Reattachment clips are sold to reattach each of the individual straight steel rods which were cut. Each side of each clip has to be individually attached to the respective ends of the corresponding cut steel rods in a field environment. Another problem with this attachment method is that the wire trays are substantially weakened. The point of angled attachment is by far the weakest point along the wire tray. It is not uncommon for steel rods to become unattached at the points of attachment.

OBJECTS OF THE INVENTION

It is an object of this invention to disclose an effective and efficient method of bending steel rod wire trays. It is an object of this invention to disclose a method of bending wire trays which results in a strong and an unweakened bent wire tray. It is an object of this invention to disclose a flexible wire tray bending jig. It is yet a further object of this invention to disclose a jig for bending a wire tray which is simple and fast to bend wire tray with. The jig disclosed herein facilitates bending wire tray both up and down. The jig disclosed herein also facilitates bending wire tray laterally to either the left or right. The jig disclosed herein also facilitates bending an additional turn in a wire tray having a first bend. It is frequently desirable, after having bent a wire tray to the left to detour around an obstruction, to bend that wire tray back to the right so that it continues its original path, say adjacent to a wall. It is also frequently desirable, after having bent a wire tray up to detour over an obstruction seated on a floor, to bend that wire tray back down so that it continues along parallel to the floor at its initial height above the floor. The jig disclosed herein facilitates a second bend a chosen variable spacing from a first bend. The jig disclosed herein can accomplish all of these feats routinely. It is a final object of this invention to disclose a wire tray bending jig which is designed to bend two sizes of wire tray. For example on may projects 2" and 4" cable trays are frequently employed. The jig disclosed herein is designed to be mounted a work surface or table top. It is possible to use this tool to bend 4" wire tray, and after wires or cables therein are quantitatively reduced (for eg. after some cables therein are routed to a first piece of equipment) then it is possible for the same tool to bend 2" wire tray!

One aspect of this invention provides for a jig for bending a wire tray made of welded wires comprising: a) an operationally non-moveable base having a top interior side portion adapted to carry a rear end portion of the wire tray, said base having a front end portion having two spaced points adapted for hangable connection; b) two swinging arms each having one end hingeably attached to the front end portion of the base to swing in a same direction as the other; c) an arm spacer having a rear end portion having two spaced points, equal in spacing to the points on the front end portion, adapted for hangable connection, and wherein each point on the spacer is pivotally attached to a central point on a corresponding swinging arm, and each central point of attachment is equally spaced along from the corresponding arm's respective point of attachment to the base so that movement of either arm moves the other arm in parallel alignment thereto; d) an interior block/clamp configured to be closely positioned within and thereafter clamp the wire tray on the base; e) an interior block/clamp configured to be closely positioned within and thereafter clamp the wire tray on the spacer; and wherein, f) the interior side portion of the base is configured to closely surround the rear exterior side portion of the wire tray. When the block/clamps are properly secured within the rear and front end portions of the wire tray then the welded wires within the base and spacer are prevented from bending.

In one preferred aspect of this invention the jig is adapted to selectively bend one of a larger and a smaller width of wire tray, and the means comprises a block/clamp having an inverted U shaped portion centrally attached thereto having an exterior lateral width dimensioned to be closely received within an interior of the larger width of wire tray, and said block/clamp having a smaller rectangular portion dimensioned to be closely received within an interior of the smaller width of wire tray; wherein use the base and spacer are vertically inverted to select upper side portions thereon to closely receive either the larger or smaller width of wire tray, and after the selected width of wire tray is positioned within the base and spacer, the block/clamps are centered thereover so that either the exterior of its inverted U shaped portion is closely received within the larger channel or alternatively, its smaller rectangular portion is closely received within the smaller wire tray.

A method of bending a wire tray comprises the steps of: a) providing a wire bending jig as specified in claim 1; b) attaching the base portion of the jig to a bench; c) removably attaching a rear portion of the wire tray within the base portion of the jig; d) pivotally attaching the swinging arms to a front portion of the base; e) pivotally and removably attaching the spacer a chosen distance along the swinging arms; f) removably attaching a front portion of the wire tray within the spacer; and, g) swinging the arms thereby bending the wire tray so that a longitudinal axis of the spacer remains parallel to a longitudinal axis of the base.

Various other objects, advantages and features of this invention will become apparent to those skilled in the art from the following description in conjunction with the accompanying drawings.

FIGURES OF THE INVENTION

FIG. 1 is a perspective view of a jig for bending wire tray. The jig shown herein can bend wire tray either vertically up or down.

FIG. 2 is a perspective view of yet another embodiment of a jig for bending wire tray. The jig shown herein can be used to bend wire tray vertically or laterally. It is shown configured to bend a wire tray vertically.

Figure 6:
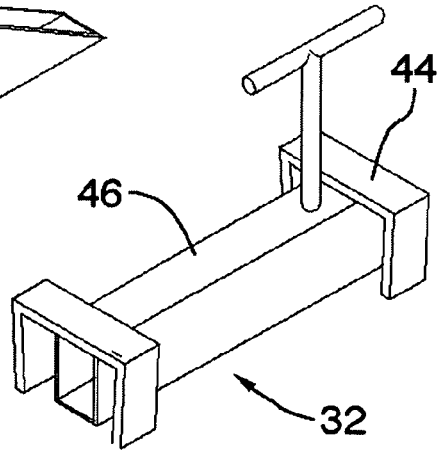

FIG. 6 is a perspective view of a block/clamp which is generally used in the base. The block/clamp is clamped on and within a rear portion of the wire tray after the rear portion of the wire tray is seated within a base of the jig. When the wire tray is so clamped, both rear interior and exterior side portions of the wire tray are held immovably so that when central portions of the wire tray are forcibly moved the wire tray bends immediately adjacent to and in front of the rear clamped portions of the wire tray.

Figure 7:
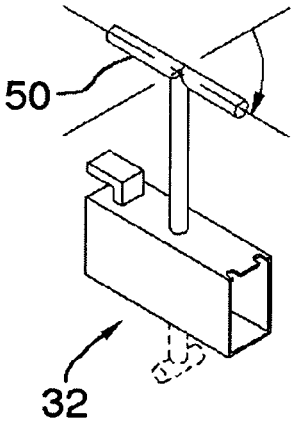

FIG. 7 is a block clamp which is similar but shorter than that shown in FIG. 6. This clamp is preferred for use in the spacer when the wire tray continues therein for a short length and then bends upwardly.

Figure 8:
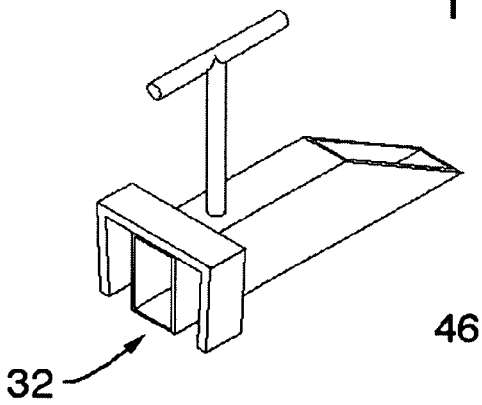

FIG. 8 is a block/clamp which is similar to that shown in FIG. 6. This clamp is preferred for use in the spacer when the wire tray continues therein for a short length and then bends downwardly.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 1:
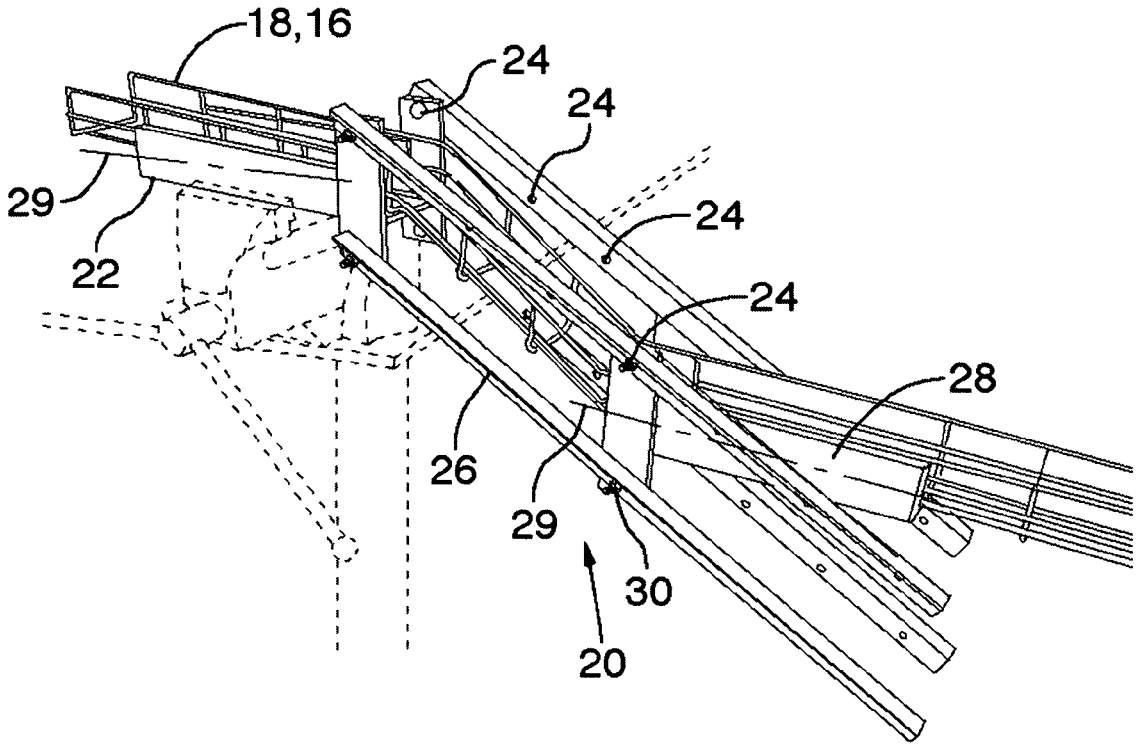

Turning now to the drawings and more particularly to FIG. 1 we have a perspective view of a jig 20 for bending wire tray 18. The jig 20 shown herein can bend wire tray 18 either vertically up or down. Most generally a jig 20 for bending a wire tray 18 made of welded wires 16 comprises: a) an operationally non-moveable base 22 having a top interior side portion adapted to carry a rear end portion of the wire tray 18, said base 22 having a front end portion having two spaced points 24 adapted for hangable connection; b) two swinging arms 26 each having one end hingeably attached to the front end portion of the base 22 to swing in a same direction as the other; c) an arm spacer 28 having a rear end portion having two spaced points 24, equal in spacing to the points 24 on the front end portion, adapted for hangable connection, and wherein each point 24 on the spacer 28 is pivotally attached to a central point on a corresponding swinging arm 26, and each central point of attachment 30 is equally spaced along from the corresponding arm's respective point of attachment to the base 22 so that movement of either arm 26 moves the other arm 26 in parallel alignment thereto; d) an interior block/clamp 32 (shown in FIG. 3 or FIG. 6) configured to be closely positioned within and thereafter clamp the wire tray 18 on the base 22; e) an interior block/clamp 32 configured to be closely positioned within and thereafter clamp the wire tray 18 on the spacer 28; and, f) means 34 (shown in FIG. 5 and FIG. 6) to closely surround a rear exterior portion of the wire tray 18. When the block/clamps 32 are properly secured within the rear and front end portions of the wire tray 18 then the welded wires 16 within the base 22 and spacer are prevented from bending.

In the most basic jig 20 shown in FIG. 1 the means 34 to closely surround a rear exterior portion of the wire tray 18 comprises an interior side portion of the base 22 configured to closely surround the rear exterior side portion of the wire tray 18. As shown in FIG. 1 the swinging arms 26 swing vertically and are hingably attached to the front end of the base 22 and the spacer 28. One point of attachment 24 is vertically above the other; so that when the arms 26 are swung vertically a longitudinal axis 29 of the spacer 28 remains in vertical alignment with and parallel to a longitudinal axis 29 of the base 22 thereby resulting in a rear horizontal portion of the tray 18, attached to an angling central portion of the tray 18, and a horizontal front portion of the tray 18 extending from the angled central portion.

In the most preferred embodiment of the invention the base 22 and the spacer 28 have opposite lateral sides and there are two pairs of similar arms 26 for stability, each pair of arms 26 pivotally attached to an adjacent lateral side of both the base 22 and the spacer 28. The arms 26 have similarly spaced pivot attachment points 24 therealong so that the rear end of the spacer 28 may be pivotally attached to the arms 26 at a chosen distance along the arms 26 thereby facilitating selective determination of the length of the angled central portion between the horizontal portions in the wire tray 18.

Figure 2:
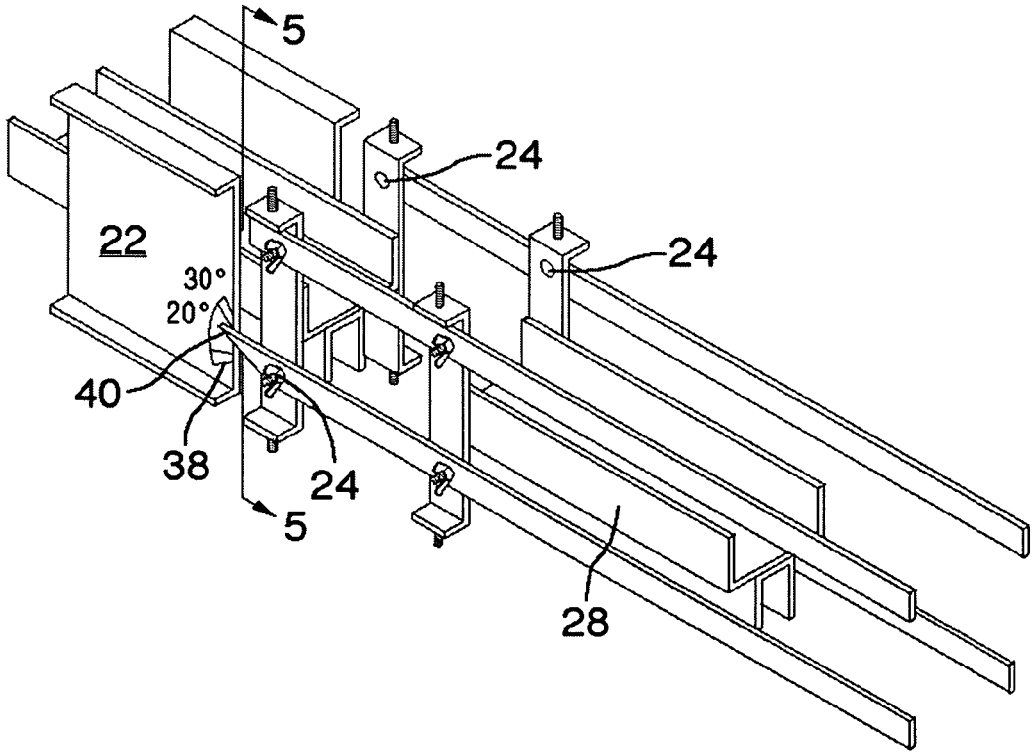
Figure 3:
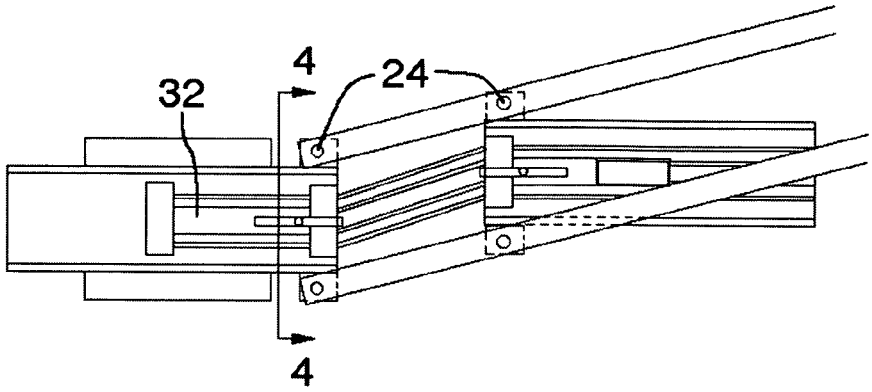
FIG. 3 is a plan view of the jig shown in FIG. 2 when it is configured to bend a wire tray laterally. The jig is shown having a smaller width wire tray clamped and bent therein.

FIG. 2 is a perspective view of yet another embodiment of a jig 20 for bending wire tray 18. The jig 20 shown in FIG. 2 can be used to bend wire tray 18 vertically or laterally. The jig 20 shown in FIG. 2 is configured to bend a wire tray 18 vertically. FIG. 3 is a plan view of the jig 20 shown in FIG. 2 when it is configured to bend a wire tray 18 laterally. The swinging arms 26 swing laterally and are hingably attached to the front end of the base 22 and adjacent end of the spacer 28. One point of attachment 24 is laterally across from the other, so that when the arms 26 are swung laterally a longitudinal axis 29 of the spacer 28 remains in horizontal alignment with, and parallel to a longitudinal axis 29 of the base 28 thereby resulting in a rear horizontal portion of the tray 18, attached to an angling central portion of the tray 18, and a horizontal front portion of the tray 18 extending from the angled central portion.

In FIG. 2 the swinging arms 26 may selectively swing either one of vertically and laterally, the swinging arms 26 are releasably hingably attached to the front end of the base 22 and the adjacent end of the spacer 28. The selection of swing is determined by choosing points of attachment 24 either one vertically above the other for vertical bending, or alternatively; one point of attachment 24 laterally across from the other for lateral bending. When the arms 26 are swung a longitudinal axis 29 of the spacer 28 remains in horizontal alignment with and parallel to a longitudinal axis 29 of the base 22 thereby resulting in a rear horizontal portion of the tray 18, attached to an angling central portion of the tray 18, and a horizontal front portion of the tray 18 extending from the angled central portion.

FIG. 2 also shows the base 22 inscribed with angular lines 38 radiating outwardly from one of its points of pivotal attachment 24 to one of the swinging arms 26. Each of said lines 38 is marked with a number of degrees indicating the angle which the tray 18 will be bent to when the arm 26 pivoting about that point of attachment 24 is swung to align with said inscribed line 38. As shown in FIG. 2 a pointer 40 may be attached to the arm 26 extending and pointing to the inscribed line 38. It is noted that the use of a pointer 40 and inscribed lines may be used to indicate the angle of bending for both vertical and lateral bending.

Figure 4:
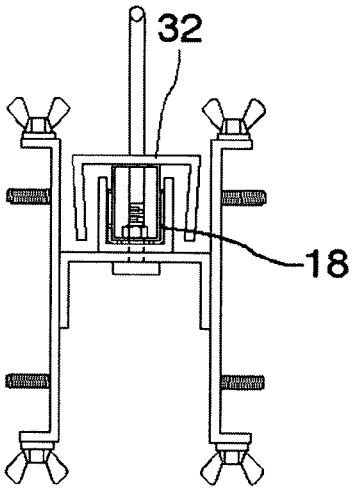
FIG. 4 is a cross sectional view taken along line 4-4 in FIG. 3.
Figure 5:
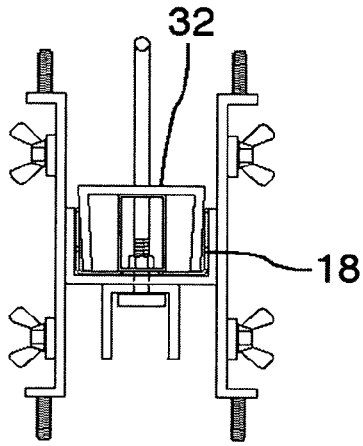
FIG. 5 is a cross sectional view taken along line 5-5 in FIG. 2. A larger width wire tray is shown secured by a block/clamp.

FIG. 4 is a cross sectional view taken along line 4-4 in FIG. 3. The jig 20 is shown in FIG. 3 has a smaller width wire tray 18 clamped and bent therein. FIG. 5 is a cross sectional view taken along line 5-5 in FIG. 2. A larger width wire tray 18 is shown secured by the block/clamp 32. The jig 20 shown in FIGS. 2, 3, 4, and 5 is adapted to selectively bend one of a larger and a smaller width of wire tray 18. The base 22 and the spacer 28 generally have an H shaped cross section. (best shown in FIGS. 4 and 5) Now, referring to FIG. 5, an upper interior side portion of the base 22 and the spacer 28 are dimensioned to closely receive a larger width of wire tray 18 and wherein a lower interior side portion of the base 22 and the spacer 28 are dimensioned to closely receive a smaller width of wire tray 18.

FIG. 6 is a perspective view of a block/clamp 32 which is generally used in the base 22. A front end portion of the block/clamp 32 further comprises an inverted U shaped portion 44 centrally attached thereto having an exterior lateral width dimensioned to be closely received within an interior of the larger width of wire tray 18. The block/clamp 32 has a smaller rectangular portion 46 dimensioned to be closely received within an interior of the smaller width of wire tray 18. The base 22 and spacer 28 are vertically inverted to select upper side portions thereon to closely receive either the larger or smaller width of wire tray 18. After the selected width of wire tray 18 is positioned within the base 22 and spacer 28, the block/clamps 32 are centered thereover so that either the exterior of its inverted U shaped portion 44 is closely received within the larger channel or alternatively, its smaller rectangular portion 48 is closely received within the smaller wire tray 18. The block/clamp 32 is clamped on and within a rear portion of the wire tray 18 after the rear portion of the wire tray 18 is seated within a base of the jig 20. When the wire tray 18 is so clamped, both rear interior and exterior side portions of the wire tray 18 are held immovably so that when a central portions of the wire tray 18 is forcibly moved the wire tray bends immediately adjacent to and in front of the rear clamped portions of the wire tray 18.

As most generally described above, the jig 20 shown in FIGS. 2, 3, 4, and 5 most preferably has two pairs of similar arms 26 for stability, and the arms 26 have similar spaced pivot attachment points 24 therealong.

FIG. 7 is a block/clamp 32 which is similar but shorter than the block clamp 32 shown in FIG. 6. This clamp is preferred for use in the spacer 28 when the wire tray 18 continues therein for a short length and then bends upwardly. FIG. 7 also shows how, in the most preferred embodiment of the invention, the block/clamp 32 is clamped by rotating the handle 50 thereof 90 degrees. FIG. 8 is a block/clamp 32 which is similar to that shown in FIG. 6. This clamp is preferred for use in the spacer 28 when the wire tray 18 continues therein for a short length and then bends downwardly.

A general method of bending a wire tray 20 comprising the steps of: a) providing a wire bending jig as specified in claim 1; b) attaching the base portion of the jig to a bench; c) removably attaching a rear portion of the wire tray within the base portion of the jig; d) pivotally attaching the swinging arms to a front portion of the base; e) pivotally and removably attaching the spacer a chosen distance along the swinging arms; f) removably attaching a front portion of the wire tray within the spacer; and, g) swinging the arms thereby bending the wire tray so that a longitudinal axis of the spacer remains parallel to a longitudinal axis of the base thereby resulting in a rear horizontal portion of the tray, attached to an angling central portion of the tray, and a horizontal front portion of the tray extending from the angled central portion.

Most preferably, that when the wire tray 18 is positioned beneath the block/clamps 32, a lateral wire 16 in the wire tray 18 is positioned immediately beneath the end portion of the block/clamp 32 adjacent to the wire tray 18 which is to be bent.

The general method described above is similar when the jig 20 comprises two pairs of similar arms 26 for stability. When the arms 26 have similar spaced pivot attachment points 24 therealong; then the method further comprises the step of pivotally attaching the arms 26 to an adjacent end of the spacer 28 at a chosen distance along the arms 26 thereby determining the length of the angled central portion between the horizontal portions in the wire tray 18 clamped in the base 22 and spacer 28.

When the jig 20 has swinging arms 26 which may selectively swing either one of vertically and laterally, and the swinging arms 26 are releasably hingably attached to the front end of the base 22 and an adjacent end of the spacer 28; the method further comprises the step of choosing points of attachment either one vertically above the other for vertical bending, or alternatively, one point of attachment laterally across from the other for lateral bending. And when the base 22 is inscribed with angular lines 38 radiating outwardly from one of its points of pivotal attachment 24 to one of the swinging arms 26, each of said lines marked with a number of degrees 40 indicating the angle which the tray 18 will be bent to; then the method further comprises the step of pivoting the arms 26 about that point of attachment 24 to align with said inscribed line 28 to a selected degree 40.

When the jig 20 is adapted to selectively bend one of a larger and a smaller width of wire tray 18; then the method further comprises the steps of vertically inverting the base 22 and spacer 28 to select upper side portions thereon to closely receive either the larger or smaller width of wire tray 18, positioning the selected width of wire tray 18 within the base 22 and spacer 28, and centering the block/clamps 32 thereover so that either the exterior of its inverted U shaped portion 44 is closely received within the larger wire tray 18 or alternatively, its smaller rectangular portion 46 is closely received within the smaller wire tray 18.

While the invention has been described with preferred specific embodiments thereof, it will be understood that this description is intended to illustrate and not to limit the scope of the invention, which is defined by the following claims.

I claim:

1. A jig for bending a wire tray made of welded wires, having bottom and opposite wire tray side wall portions which define a generally uniform interior opening therealong, comprising:

a) an operationally non-moveable base having a top interior side portion adapted to carry a rear end portion of the wire tray, said base having a front end portion having two spaced points adapted for hangable connection;

b) two swinging arms each having one end hingably attached to the front end portion of the base to swing in a same direction as the other;

c) an arm spacer having a rear end portion having two spaced points, equal in spacing to the points on the front end portion, adapted for hangable connection, and wherein each point on the spacer is pivotally attached to a central point on a corresponding swinging arm, and each central point of attachment is equally spaced along from the corresponding arm's respective point of attachment to the base so that movement of either arm moves the other arm in parallel alignment thereto;

d) an interior block/clamp configured to be closely positioned within and thereafter clamp the wire tray on the base, said block\clamp substantially filling the interior of the tray to i) initially facilitate clamping the wire tray on the base, and ii) additionally support the interior bottom and side wall portions of the wire tray when a unidirectional bending force is applied to one exterior side of the tray, thereby maintaining the shape of the wire tray, and preventing the wire tray from internally collapsing;

e) an interior block/clamp configured to be closely positioned within and thereafter clamp the wire tray on the spacer, said block\clamp substantially filling the interior of the tray to i) facilitate clamping the wire tray on the spacer, and ii) additionally support the interior bottom and side wall portions of the wire tray when a unidirectional bending force is applied to one exterior side of the tray, thereby maintaining the shape of the wire tray, and preventing the wire tray from internally collapsing; and wherein, f) the interior side portion of the base and the spacer are configured to closely surround the rear exterior bottom and side wall portions of the wire tray;

so that when the block/clamps are properly secured within the rear and front end portions of the wire tray, and the tray wall portions are clamped between the block/clamps and the closely surrounding interior side portions, then when force is applied to the one exterior side of the tray, wall deformation is prevented along the wire tray between the interior block/clamps and the closely surrounding interior side portions of the base and spacer, and thereby the interior clamped wire tray wall portions and opening are maintained without deformation, as well as ensuring relatively sharp bending between, and immediately adjacent to the clamped portions of the wire tray.

2. A jig as in claim 1 wherein the swinging arms swing vertically and are hingably attached to the front end of the base and the rear end of the spacer, one point of attachment vertically above the other; so that when the arms are swung vertically a longitudinal axis of the spacer remains in vertical alignment with and parallel to a longitudinal axis of the base thereby resulting in a rear horizontal portion of the tray, attached to an angling central portion of the tray, and a horizontal front portion of the tray extending from the angled central portion.

3. A jig as in claim 2 wherein the base and the spacer have opposite lateral sides and wherein there are two pairs of similar arms for stability, each pair pivotally attached to an adjacent lateral side of both the base and the spacer.

4. A jig as in claim 3 wherein the arms have similar spaced pivot attachment points therealong so that the rear end of the spacer may be pivotally attached to the arms at a chosen distance along the arms thereby facilitating selective determination of the length of the angled central portion between the horizontal portions in the wire tray clamped in the base and spacer.

5. A jig as in claim 1 wherein the swinging arms swing laterally and are hingably attached to the front end of the base and the adjacent end of the spacer, one point of attachment laterally across from the other; so that when the arms are swung laterally a longitudinal axis of the spacer remains in horizontal alignment with and parallel to a longitudinal axis of the base thereby resulting in a rear horizontal portion of the tray, attached to an angling central portion of the tray, and a horizontal front portion of the tray extending from the angled central portion.

6. A jig as in claim 1 wherein the swinging arms may selectively swing either one of vertically and laterally, the swinging arms are releasably hingably attached to the front end of the base and the rear end of the spacer, said selection of swing determined by choosing points of attachment either one vertically above the other for vertical bending, or alternatively; one point of attachment laterally across from the other for lateral bending, so that when the arms are swung a longitudinal axis of the spacer remains in horizontal alignment with and parallel to a longitudinal axis of the base thereby resulting in a rear horizontal portion of the tray, attached to an angling central portion of the tray, and a horizontal front portion of the tray extending from the angled central portion.

7. A jig as in claim 1 wherein the base is inscribed with angular lines radiating outwardly from one of its points of pivotal attachment to one of the swinging arms, each of said lines marked with a number of degrees indicating the angle which the tray will be bent to, when the arm pivoting about that point of attachment is swung to align with said inscribed line.

8. A jig as in claim 2 adapted to selectively bend one of a larger and a smaller width of wire tray, wherein the base and the spacer generally have an H shaped cross section and wherein an upper interior side portion of the base and the spacer are dimensioned to closely receive a larger width of wire tray and wherein a lower interior side portion of the base and the spacer are dimensioned to closely receive a smaller width of wire tray; and wherein a front end portion of the block/clamp further comprises an inverted U shaped portion centrally attached thereto having an exterior lateral width dimensioned to be closely received within an interior of the larger width of wire tray, and said block/clamp having a smaller rectangular portion dimensioned to be closely received within an interior of the smaller width of wire tray; wherein use the base and spacer are vertically inverted to select upper side portions thereon to closely receive either the larger or smaller width of wire tray, and after the selected width of wire tray is positioned within the base and spacer, the block/clamps are centered thereover so that either the exterior of its inverted U shaped portion is closely received within the larger channel or alternatively, its smaller rectangular portion is closely received within the smaller wire tray.

9. A jig as in claim 8 wherein the base and the spacer have opposite lateral sides and wherein there are two pairs of similar arms for stability, each pair pivotally attached to a corresponding lateral side of both the base and the spacer.

10. A jig as in claim 9 wherein the arms have similar spaced pivot attachment points therealong so that the rear end of the spacer may be pivotally attached to the arms at a chosen distance along the arms thereby facilitating selective determination of the length of the angled central portion between the horizontal portions.

11. A method of bending a wire tray comprising the steps of:

a) providing a wire bending jig as specified in claim 1;

b) attaching the base portion of the jig to a bench;

c) removably attaching a rear portion of the wire tray within the closely surrounding base portion of the jig with the block/clamp;

d) pivotally attaching the swinging arms to a front portion of the base;

e) pivotally and removably attaching the spacer a chosen distance along the swinging arms;

f) removably attaching a front portion of the wire tray within the closely surrounding spacer with the block/clamp; and, g) swinging the arms thereby bending the wire tray so that a longitudinal axis of the spacer remains parallel to a longitudinal axis of the base thereby resulting in a rear horizontal portion of the tray, attached to an angling central portion of the tray, and a horizontal front portion of the tray extending from the angled central portion and so that when force is applied to the one exterior side of the tray, wall deformation is prevented along the wire tray between the interior block/clamps and the closely surrounding interior side portions of the base and spacer, and thereby the interior clamped wire tray wall portions and opening are maintained without deformation, as well as ensuring relatively sharp bending between, and immediately adjacent to the clamped portions of the wire tray.

12. A method as in claim 11 wherein when the wire tray is positioned beneath the block/clamps, a lateral wire in the wire tray is positioned immediately beneath the end portion of the block/clamp adjacent to the wire tray which is to be bent.

13. A method as in claim 11 wherein the base and the spacer have opposite lateral sides and wherein there are two pairs of similar arms for stability, and each pair of arms is pivotally attached to an adjacent lateral side of both the base and the spacer.

14. A method as in claim 13 wherein the arms have similar spaced pivot attachment points therealong; and further comprising the step of pivotally attaching the arms to a adjacent end of the spacer at a chosen distance along the arms thereby determining the length of the angled central portion between the horizontal portions in the wire tray clamped in the base and spacer.

15. A method as in claim 14 wherein the jig has swinging arms which may selectively swing either one of vertically and laterally, the swinging arms are releasably hingably attached to the front end of the base and the rear end of the spacer; and further comprising the step of choosing points of attachment either one vertically above the other for vertical bending, or alternatively; one point of attachment laterally across from the other for lateral bending.

16. A method as in claim 15 wherein the base is inscribed with angular lines radiating outwardly from one of its points of pivotal attachment to one of the swinging arms, each of said lines marked with a number of degrees indicating the angle which the tray will be bent to; and further comprising the step of pivoting the arms about that point of attachment to align with said inscribed line of a selected degree.

17. A method as in claim 15 wherein the jig is adapted to selectively bend one of a larger and a smaller width of wire tray, wherein the base and the spacer generally have an H shaped cross section and wherein an upper interior side portion of the base and the spacer are dimensioned to closely receive a larger width of wire tray and wherein a lower interior side portion of the base and the spacer are dimensioned to closely receive a smaller width of wire tray; and wherein a front end portion of the block/clamp further comprises an inverted U shaped portion centrally attached thereto having an exterior lateral width dimensioned to be closely received within an interior of the larger width of wire tray, and said block/clamp has a smaller rectangular portion dimensioned to be closely received within an interior of the smaller width of wire tray; further comprising the step of vertically inverting the base and spacer to select upper side portions thereon to closely receive either the larger or smaller width of wire tray, positioning the selected width of wire tray within the base and spacer, and centering the block/clamps thereover so that either the exterior of its inverted U shaped portion is closely received within the larger channel or alternatively, its smaller rectangular portion is closely received within the smaller wire tray.

* * * * *